United States Patent [19]

Gould et al.

[11] Patent Number: 5,040,663

[45] Date of Patent: Aug. 20, 1991

[54] APPARATUS AND METHOD FOR STACKING

[75] Inventors: Steven G. Gould, Denmark; James E. Hertel, Green Bay, both of Wis.

[73] Assignee: Paper Converting Machine Company, Green Bay, Wis.

[21] Appl. No.: 414,681

[22] Filed: Sep. 29, 1989

Related U.S. Application Data

[63] Continuation-in-part of Ser. No. 201,583, Jun. 2, 1988, abandoned.

[51] Int. Cl.[5] ..... B65G 57/03

[52] U.S. Cl. ..... 198/419.3; 414/790.4; 414/790.8; 414/793.9

[58] Field of Search ..... 414/790.1, 790.4, 790.6, 414/790.7, 793.9, 923, 924; 271/217, 218; 198/419.3

[56] References Cited

U.S. PATENT DOCUMENTS

| | | | |
|---|---|---|---|
| 3,088,604 | 5/1963 | Nilsson | 271/218 X |
| 3,507,492 | 4/1970 | Spencer | 271/218 X |
| 3,526,170 | 9/1970 | Oderman | 414/790.6 X |
| 3,675,792 | 7/1972 | Griner | 414/790.4 X |
| 4,162,733 | 7/1979 | Wiseman | 414/790.4 X |
| 4,357,126 | 11/1982 | Kidd | 414/790.8 X |
| 4,397,229 | 8/1983 | Merwarth | 414/790.4 X |
| 4,593,896 | 6/1986 | Nakamura | 271/218 X |

*Primary Examiner*—Robert P. Olszewski
*Assistant Examiner*—Craig Slavin
*Attorney, Agent, or Firm*—Tilton, Fallon, Lungmus & Chestnut

[57] ABSTRACT

Apparatus and method for stacking product such as flexible paper towels including a slotted wheel in combination with at least two endless chain conveyors equipped with finger assemblies which are orbitally offset so that while one finger assembly of one chain conveyor is accumulating a plurality of substacks, a first finger assembly of the other chain conveyor is being readied to take over the development of a successive stack, and programmable servo motor associated with the chain conveyors for varying the finger assembly advance during different portions of the orbital movement of the finger assemblies.

4 Claims, 5 Drawing Sheets

CURVES ILLUSTRATED ARE BASED ON 30 PRODUCTS PER STACK

APPARATUS AND METHOD FOR STACKING

This is a continuation-in-part of our copending application Serial No. 201,583 filed June 2, 1988, now abandoned.

BACKGROUND AND SUMMARY OF INVENTION

This invention relates to an apparatus and method for stacking and, more particularly, to relatively flexible products such as paper towels and the like.

In the production of converted paper products (and other products as well), it is frequently desirable to package the product in stacks. For example, C-folded paper towels are frequently sold in packs of 200 towels (stacked). This is a somewhat higher count than that utilized 25 years ago (see co-owned U.S. Pat. 3,254,889) but the problems are the same. It is always a matter of developing square stacks of exact count at high speed.

The towels, for example, are formed continuously by slitting a wide web into five or six narrow strips of web and then longitudinally folding each strip by passing them over folding boards folded strips are t routed to travel combined into a ribbon of stacked strips. The ribbon is cut into towel lengths and these substacks of towels are called clips which are turned 90° before going into the stacker. Apparatus showing this general arrangement can be seen in co-owned British Patent 2,028,774.

Final, salable stacks are formed then by stacking a fixed number of clips to yield the package quantity of towels. The final stacking operation is frequently the speed limiting part of the process and requires complicated mechanical assemblies to run at production speeds. The object of this invention is to simplify the final tacking operation while maintaining or increasing the potential speed of the production line. A further object is to provide ease of stack count changes and flexibility for culling off-specification products.

In the illustrated embodiment of the invention, slotted wheel means is employed in conjunction with endless chain conveyors in the general arrangement seen in our earlier, co-owned U.S. Pat. No. 4,736,936. In the illustrated embodiment of the invention, the endless conveyors are equipped with diving fingers—with the fingers on one conveyor being spaced orbitally from the fingers of the other conveyor so as to develop alternate stacks.

Other pertinent prior art patents are Yamada et al U.S. Pat. No. 4,511,136 which shows a slotted wheel and Merworth U.S. Pat. No. 4,398,455 which shows stacking apparatus employing pairs of conveyors.

The invention is described in conjunction with the illustrative embodiment in the accompanying drawing, in which.

DETAILED DESCRIPTION

Figure 1:
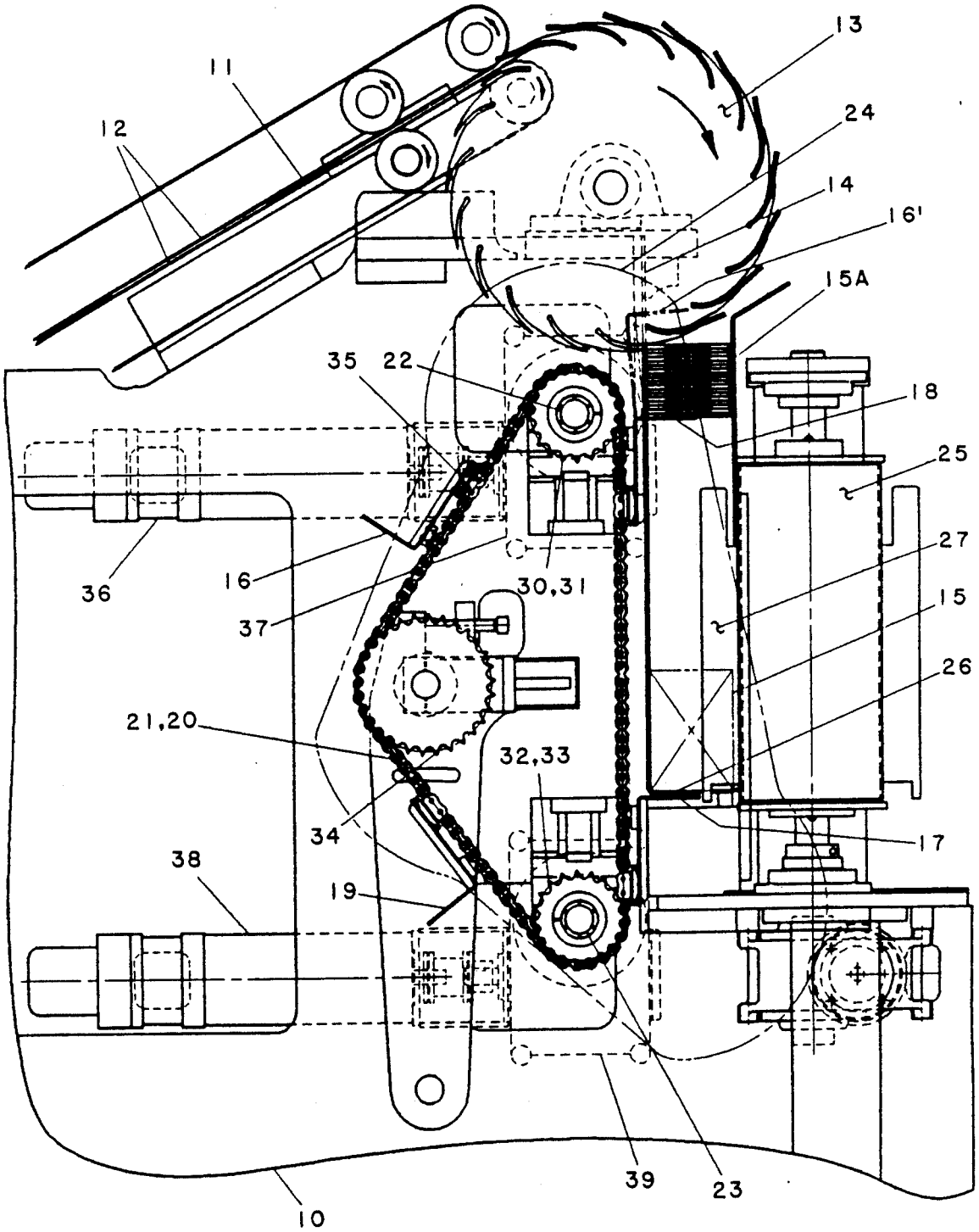
FIG. 1 is a fragmentary side elevational view of apparatus for practicing the invention.

In the illustration given and with reference first to FIG. 1, the numeral 10 designates the machine frame. In accordance with the usual practice in machines for converting paper product, the frame includes a pair of spaced apart side frames such as are clearly seen at the lower right hand portion of FIG. 2. The side frames are suitably connected to provide a rigid support for the various moving elements, the structure and function of which can be most readily understood by considering the general operation of the apparatus.

OPERATION GENERALLY

Individual product clips 11 are carried by a belt conveyor 12 and inserted into individual slots in a slotted wheel 13 rotating in the direction of product travel but slowing the product velocity by a factor of from ⅓ to 1/5 of entrance velocity. Other means such as seen in U.S. Pat. No. 4,736,936 may be used for advancing and introducing the product into the slitted wheel.

The slotted wheel 13 carries the products 11 around until they impact on stripper fingers 14 which are fixed relative to the frame 10. By this means, the product is stripped out of the slotted wheel 13 and stacked in a continuous manner on top of each other.

To accomplish separation of the continuously formed substacks of clips 11 into a completed stack 15 (a partial stack is designated 15A in the upper right hand portion of FIG. 1), sets of count finger assemblies 16, 17 and 18, 19 are mounted on multiple parallel continuous chain conveyors 20, 21 respectively. As can be appreciated from a consideration of the right hand portion of FIG. 2, the chains of conveyor 20 are the two outboard ones while the inboard chains constitute the chain conveyor 21.

The chains are mounted on upper and lower sprockets and travel in a generally vertical manner. Each chain set 20, 21 with its associated count fingers 16, 17 and 18, 19 is independently driven. For example, chain set 20 is driven at 22 (clearly seen in the upper central portion of FIG. 1) and idles at the lower position 23. On the other hand, set 21 is driven at 23 and idles at 22.

The upper sprocket is sized and located and the count finger shaped such that in combination, they form the insertion path 24 (see the upper right hand portion of FIG. 1) for the top of the count finger (shown in dashed line and designated 16') to pass between adjacent product clips 11, thus separating the products into individual stacks 15, 15A, etc.

When separation is completed (fingers 16' fully inserted), chain 20 is decelerated to a slower speed for stack building at the specific product bulk. On the other hand, chain 21 with the operative count finger 18 supporting a now completed stack accelerates down to a position in alignment with stack removal means 25, drops off the stack 15 at the stack removal platform 26, decelerates and adjusts speed in preparation for insertion of count finger 19 between stacks. This process then repeats itself with subsequent insertion of finger assemblies 19, then 17, then 18 and back to 16.

As soon as each completed stack 15 reaches the platform 26, a conveyor paddle 27 provided as part of the means 25 removes that stack for packaging.

DETAILED DESCRIPTION OF CHAIN CONVEYOR

Figure 2:
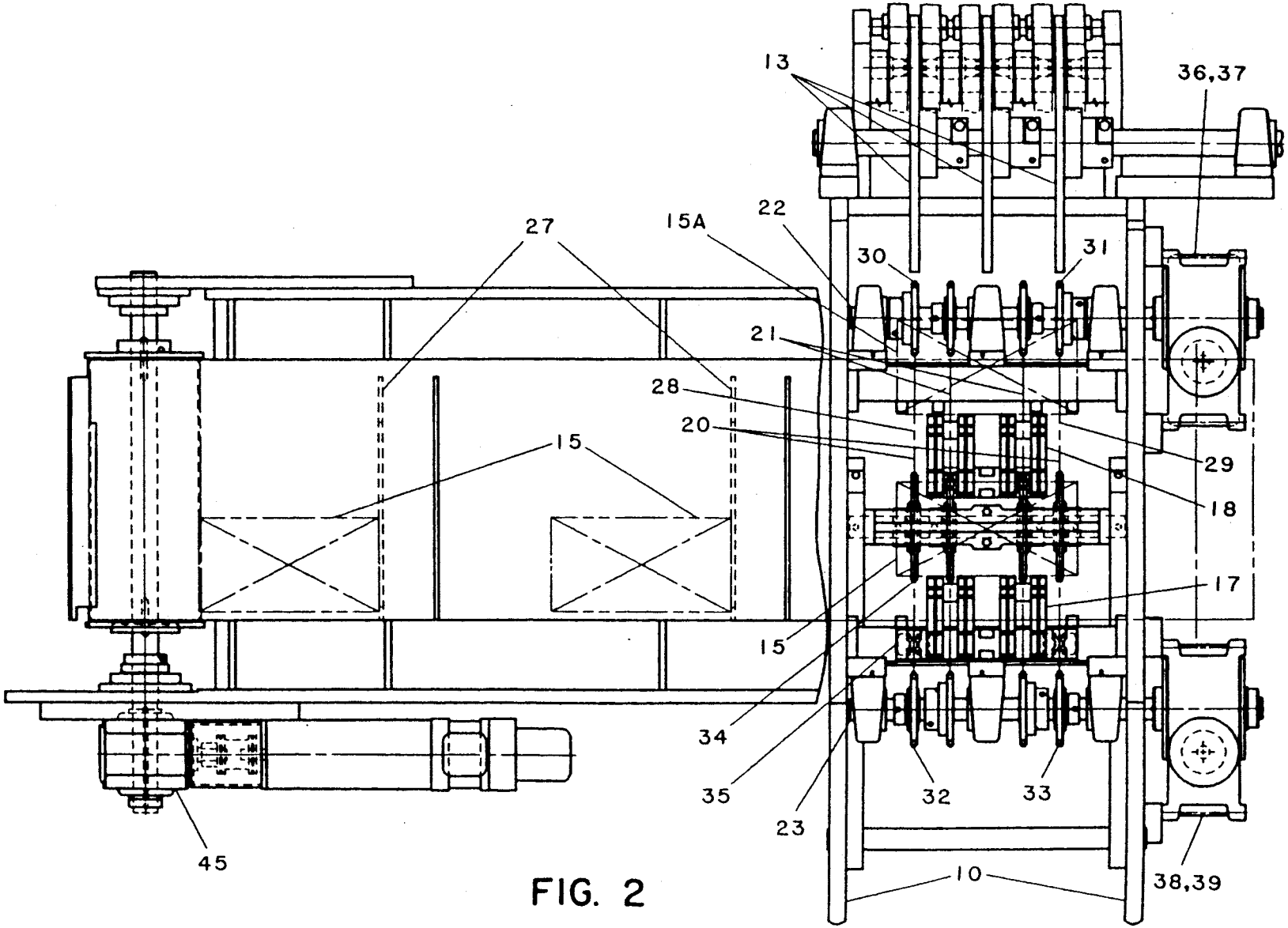
FIG. 2 is a front elevational view of the apparatus of FIG. 1.

Chain conveyor 20 includes endless chains 28, 29 (see the upper central portion of FIG. 2). These chains are entrained over upper driven sprockets 30, 31 which rotate about the axis 22 and are also entrained over lower idler sprockets 32, 33 which rotate about the axis 23. Additionally, these chains are entrained about tensioning sprockets 34—see the central right hand portion of FIG. 1.

Mounted on the chains 28, 29 are finger assemblies 16, 17 via bars as at 35 seen relative to the fingers 16 in the upper central portion of FIG. 1. The chains 28, 29 are driven about the axis 22 by means of a programmable servo motor 36 operating through a right angled gear reducer 37 (shown schematically) or, alternatively, a cam box in the position of reducer 37.

The chain conveyor 21 is similarly arranged and operated except that it is 180° out of phase to chain conveyor 20. This is because there are two chain conveyors employed. For ease of layout and construction, the chain conveyor 21 is driven about the axis 23 by a programmable servo motor or cam box 38 and right angle gear reducer 39 (see the lower portion of FIG. 1)—and idled about the axis 22.

DETAILED DESCRIPTION OF PROGRAM OF OPERATION

Figure 3:
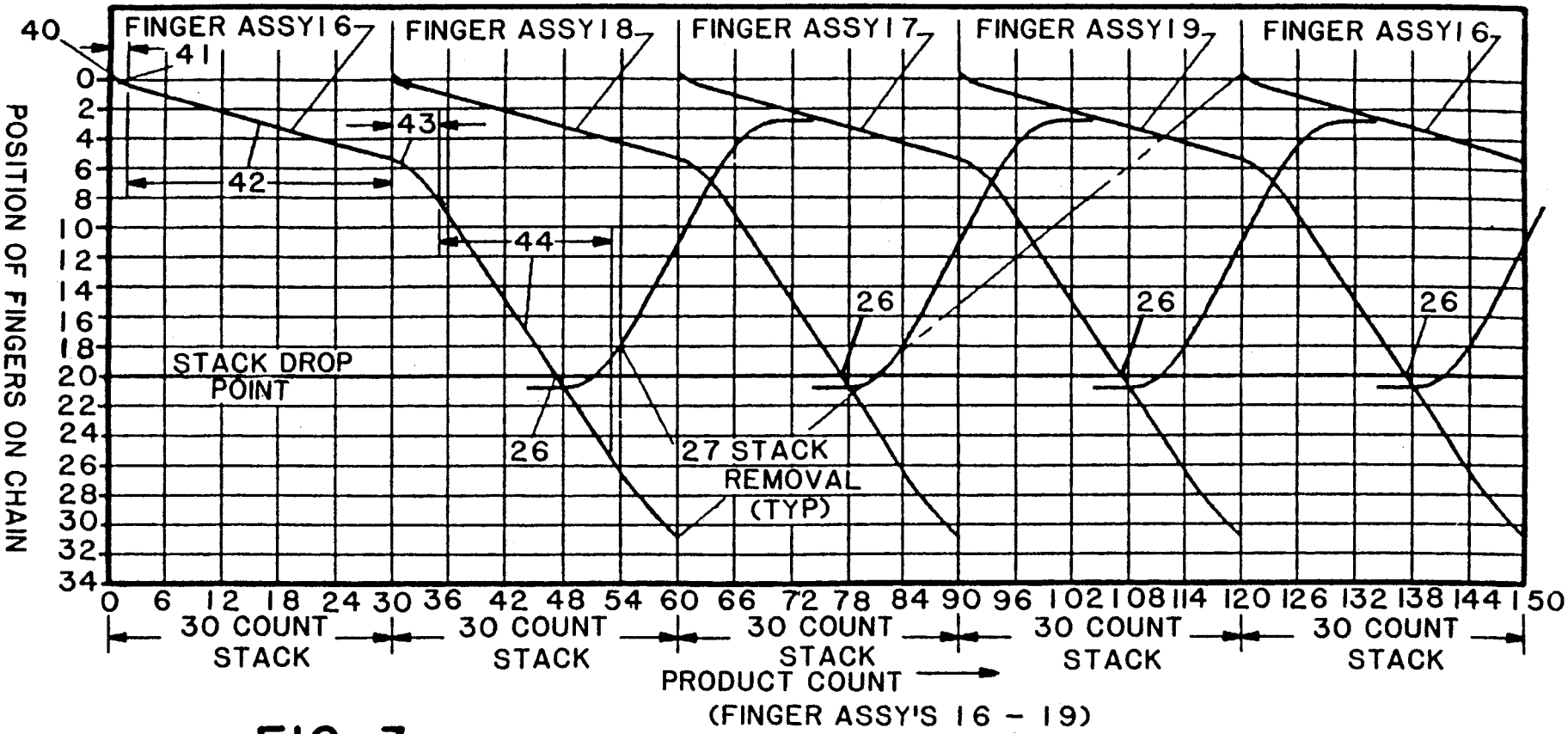
FIG. 3 is a graph relating the finger position to time, i.e., product count.

Referring to FIG. 3 there are four stepped lines designated 16, 18, 17, 19 which represent the positions of the finger assemblies 16–19 through five cycles of stacked development. For ease of presentation, the curves correspond to a 30 count stack.

Focusing on line 16, the point 40 at the extreme upper left hand portion of FIG. 3 represents the start of the diving function illustrated at 16' in FIG. 1. This is also designated 40 in FIG. 4 which shows the speed of fingers 16 as a function of time. It will be appreciated that the finger assembly 16' when traveling around the axis 22 moves at relatively high speed for the diving function. Additional details on this can be seen in co-owned U.S. Pat. No. 4,285,621.

Figure 4:
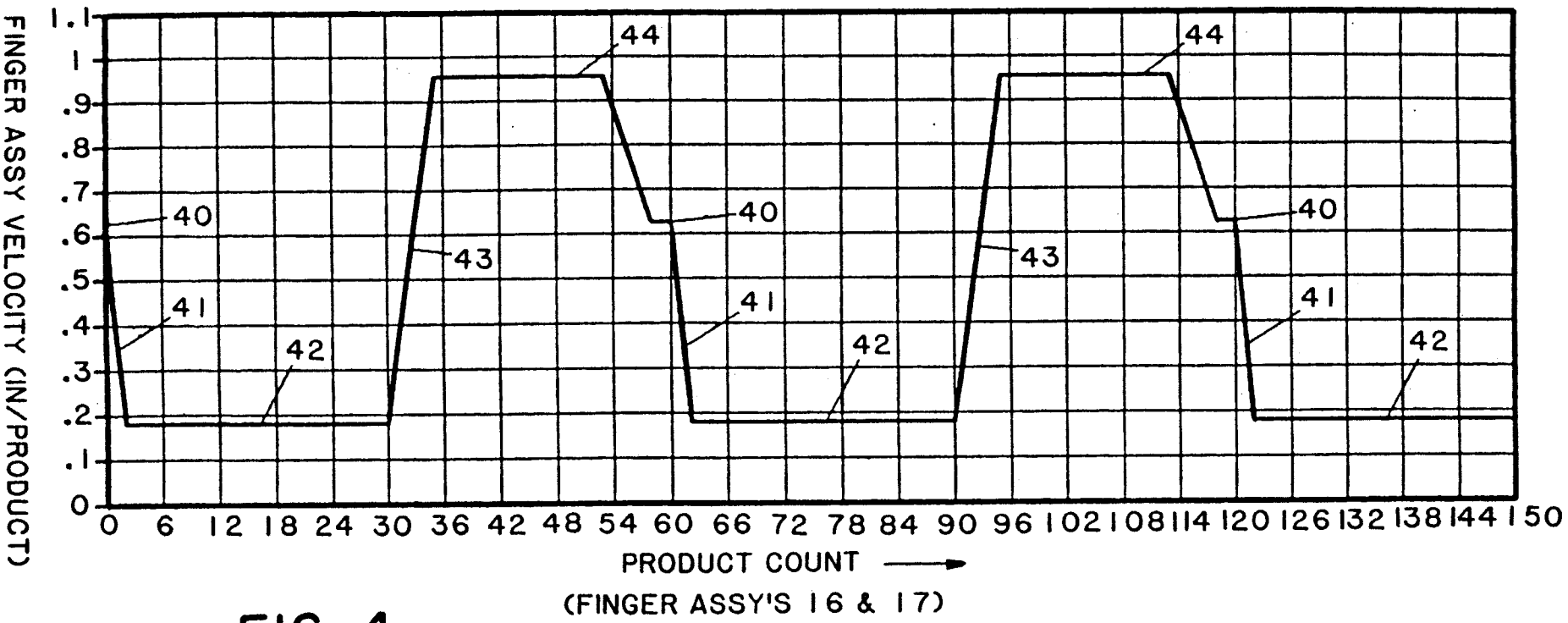
FIGS. 4 and 5 are graphs relating finger assembly velocity to product count.

Still referring to FIG. 4, there is a rapid deceleration at 41 which is illustrated by the segment 41 in FIG. 3. The next mode of operation for finger 16 is the stacking function at which time the finger 16 is lowered gradually as illustrated by the segment 42 in FIG. 3. This occurs at a constant, lower speed also designated 42 in FIG. 4.

After a stack is completed, the finger 16, rapidly accelerates as indicated by the segment 43 in FIGS. 3 and 4—which is approximated by the point 43 in FIG. 3. When reaching the higher speed indicated at 44 in FIG. 4, the finger 16 continues downward as indicated also at 44 in FIG. 3.

During this downward movement, the finger assembly 16 passes through the platform 26 which results in shifting the stack 15 from the finger assembly 16 to the platform 26 for removal by one of the conveyor paddles 27. The conveyor paddles 27 are part of the stack removal means 25 which is powered by motor means 45 seen at the extreme lower left hand portion of FIG. 2. Many variations in the stack removal can be utilized inasmuch as the stack is now complete and free of control of the chain conveyor.

Figure 5:
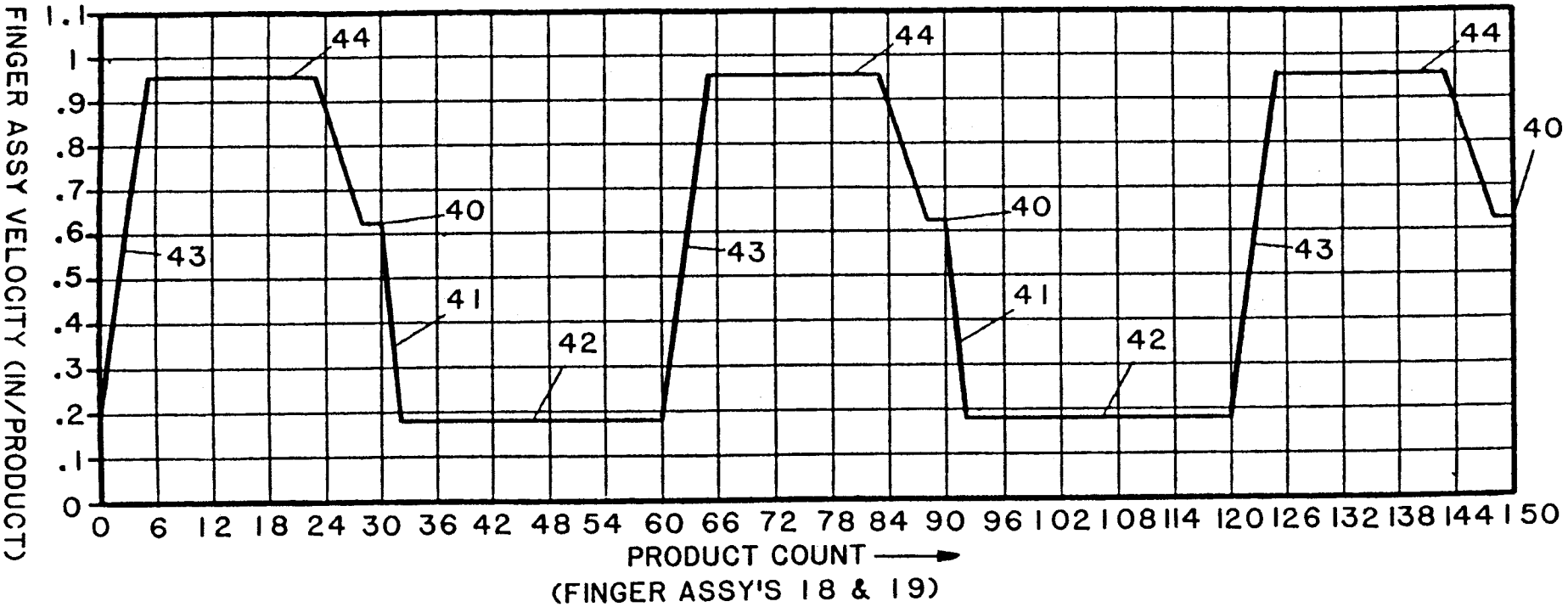

It will be appreciated that the velocity profile of finger assembly 17—as a function of time or product count is identical to that of finger assembly 16. On the other hand, finger assemblies 18 and 19 have a velocity profile as seen in FIG. 5 which is shifted relative to the showing in FIG. 4.

Returning to a consideration of finger assembly 16, when the stack is completed, this assembly moves upwardly in the non-stacking portion of its orbit—as illustrated in the left hand portion of FIG. 1. There it travels about the tensioning sprockets 34. During this time the other finger assemblies 19, 17 and 18 follow the same sequence in developing stacks of product. In other words, each cycle of stack production represents one-half the orbit of a given conveyor chains. And the second conveyor chain is 180° out of phase with the first conveyor chain. Also, it will be appreciated from FIG. 4 that while the finger assembly 16 is not operating on product, it still follows the same deceleration-acceleration sequence because its supporting chain is governed by the driven sprockets 30, 31 which at this time is driving the finger assembly 17 through the stacking mode.

SUMMARY OF OPERATION

In the practice of the invention utilizing the embodiment of the apparatus illustrated in the drawing, spaced apart products 11 are advanced along a first path defined by a belt conveyor 12. Although the description given hereinbefore is directed to C-fold towel production, it is possible to utilize the inventive apparatus and method for a variety of products. With changes for example in the slotted wheel and chain geometrys combined with timing changes for the programmable servo drive (or cam drive) many other products can be stacked utilizing the invention.

As the products 11 are advanced, they encounter sequentially a slotted wheel 31 which is mounted on the frame 10 for rotation. Thus, the slotted wheel is effectively in the first path and receives product adjacent to the zenith of the second generally arcuate path of travel developed by the slotted wheel. From a consideration of the upper portion of FIG. 1, it will be seen that the slotted wheel rotates clockwise and conveys the product sequentially along a path from about 1 o'clock to about 5 o'clock.

At the 5 o'clock position which is adjacent the nadir of the arcuate second path, the products sequentially encounter strippers 14 which remove the product sequentially or delivery into a third path defined by the vertical downward run of a pair of chain conveyors 20, 21.

The arrangement of the chain conveyors relative to each other can be appreciated best from the right hand portion of FIG. 2 where the numeral 20 refers to the two outboard chains while the numeral 21 refers to the two inboard chains.

Still referring to FIG. 2, it will be seen that the outboard chains are entrained about sprockets 30 and 31 at their upper reach and these are driven in the illustration given by mens of a servo motor 36 and right angled gear box 37. The lower reach of the chains making up the conveyor 20 is defined by sprockets 32 and 33 which are idler or free running sprockets. For ease of construction, the chains making up the inboard conveyor 21 are driven at the bottom and idled at the top. It can be appreciated that the driving means 38, 39 is positioned in the lower right hand portion of FIG. 2.

Each chain of each conveyor is equipped with at least one outwardly projecting finger. In the illustrated embodiment the chains of conveyor 20 are equipped with the fingers 16 and 17 seen in the right central portion of FIG. 1. Each finger is part of a supporting bar 35 (referring to the fingers 16) which is rigidly attached to its associated chain.

The chains of conveyor 21 are also equipped with outwardly projecting fingers as at 18 and 19 and it will be seen from a consideration of FIG. 1 that these fingers are arranged in longitudinally interlaced relation to the fingers of the conveyor 20.

While one conveyor is accumulating product of a stack, the other conveyor is rapidly moving a previously completed stack out of the way of the developing stack for deposit on a platform 26. This is positioned adjacent the nadir of the generally obround third path. The platform 26 is slotted so that the four pairs of fingers can pass therethrough incident to return to stack defining position. From this, it will be seen that rapid stack buildup and removal is achieved by a pair of conveyors both having the same chain path. In effect, the fingers of one conveyor perform the diving, supporting and positioning for removal functions while the fingers of the other chain perform the same sequence of functions but are 180° out of phase.

An advantageous feature of the invention is the programming of movement and velocity of the fingers during a traverse around the obround third path. Each finger first serves as a diving finger—see the dashed line showing designated 16' in the upper right hand portion of FIG. 1—for defining the end of a previous stack and the commencement of a developing stack. This is illustrated graphically at the point 40 in FIGS. 3 and 4 relative to the fingers 16. By virtue of the finger in the position 16' passing around the upper sprocket the diving is achieved very rapidly in comparison with the finger movement in the straight runs in the third path. Once the finger 16 has reached the straight vertically downward run, it is decelerated rapidly a can be appreciated from the portions 41 in FIGS. 3 and 4. The finger thereupon enters its accumulating mode which is designated 42 in FIGS. 3 and 4 and from those views it will be seen that the velocity is constant and the finger moves downward slowly until a complete stack is achieved. For each of presentation, the graphs of FIGS. 3-5 are in terms of a 30 count stack so as not to have unduly long abscissae.

Once the stack has been accumulated—as represented by the point 43 in FIG. 3, the chain associated with the supporting finger in that mode is rapidly accelerated as can be appreciated from the portion 43 of the curve of FIG. 4. There upon, acceleration stops and a constant velocity of descent is provided in the conveying chains to provide the curve portion designated 44. It is during this constant speed descent that the stack encounters the platform 26 which is indicated in FIG. 3 is the stack drop point. Thereafter, the paddles 27 of the stack removal means 25 remove the stack from the platform 26—and it will be seen that the succeeding finger assembly 18 provided on the other conveyor 21 is in its stack accumulating mode so there is no interference with the removal operation.

Also, it will be seen from a consideration of FIG. 3 that the finger assembly 18 is inserted into the second and third paths substantially with the completion of the stack being supported by the finger 16, viz., at the point designated 43.

So we have provided a pair of chain conveyors working through the same chain path but operating in tandem and at varying speeds determined according to a preset program so that when one conveyor is developing a stack, the other conveyor is rapidly removing a previous stack from the vicinity and ultimately from the stack developing path.

As indicated previously, a variety of products can be stacked through the practice of the invention. For each product, it is advantageous to develop a diving velocity of the finger (in the position 16') which is a function of the wheel geometry and the finger geometry. The wheel utilizes "shallow" slots with a fairly wide spacing. For example, the C-fold stacker wheel diameter is approximately six times the machine direction product length (MDPL) which length is about 3½" for C-fold towels, whereas Yamada's wheel diameter is about equal to one MDPL. Also, the C-folder slot depth extends in only about 10–20% of the wheel radius whereas Yamada's slots spiral in through about 75% of the wheel radius.

Our finger geometry utilizes a path which sweeps the tip of the finger forward into the oncoming stream of product in the wheel. To accomplish this path, we displace the horizontal platform of the finger significantly above its attachment point on the chain, i.e., the vertical length of the L-shaped finger is approximately equal to 1–2 MDPL. The horizontal leg of the L is about 0.6–1.0 MDPL.

The upper sprocket 22 is also advantageously designed to having a pitch line diameter approximately equal to 0.75–1.25 MDPL in order to provide adequate velocity to the finger tip at the point of insertion into the product stream. We have also found that the stacking velocity is a function of the product thickness and the rate of product advance—as by the conveyor bolts 12. The chain is provided with continuous motion during insertion into the product stream. The chain is then decelerated to the speed required for the stack buildup rate. This chain motion is well illustrated in FIG. 3. Further, the lowering velocity is a function of the rate of building the next stack and the time of removal of the first stack. These variables are advantageously controlled by a programmable servo motor so as to achieve the maximum speed without the possibility of one stack interfering with another.

While in the foregoing specification, a detailed description of an embodiment of the invention has been set down for the purpose of illustration, many variations in the details hereingiven may be made by those skilled in the art without departing from the spirit and scope of the invention.

We claim:

1. Apparatus for accumulating products into stacks comprising a frame:

means on said frame for advancing a series of longitudinally spaced products along a first path, a slotted wheel rotatably mounted in said first path for sequentially receiving said product for transmission along a second generally arcuate path, stripper means on said frame in said second path, the slots of said wheel extending in only a minor proportion of the radius thereof, a pair of endless conveyors on said frame each equipped with at least one outwardly projecting finger rigidly fixed thereon for finger movement through a third orbital path intersecting said second path for receiving products stripped from said slotted wheel, the finger of one conveyor being positioned in said third path in longitudinally spaced relation to the finger of the other conveyor, and means operably associated with said conveyors for varying the relative speeds thereof so that each finger first serves as a diving finger for defining the end of a previous stack and the commencement of a developing stack and thereafter serves as a descending platform for said developing stack while a finger from the other conveyor moves into diving position, and when the developing stack is completed the first finger thereafter rapidly descends to a stack removal position, said other conveyor finger being inserted into said third path substantially simultaneously with the completion of said developing stack, said wheel slots extending in about 10–20% of the wheel radius, said fingers being L-shaped and when in said third path, having a horizontal leg extending about 0.6–1 times the machine direction product length and a vertical leg fixed to its associated conveyor about 1–2 times the said product length below the horizontal leg.

2. The apparatus of claim 1 in which each conveyor includes a pair of spaced apart chains entrained about upper and lower sprockets, the upper sprockets for one conveyor being driven and the lower sprockets being driven for the other conveyor, the upper sprockets having a pitch line diameter about 0.75–1.25 times the said product length.

3. Apparatus for accumulating products into stacks comprising:

a frame, means on said frame for advancing a series of longitudinally spaced product along a first path, a slotted wheel rotatably mounted in said first path for sequentially receiving said products for transmission along a second generally arcuate path, the slots of said wheel extending in only about 10–20% of the wheel radius, stripper means on said frame in said second path, a pair of endless conveyors on said frame each equipped with at least two spaced apart, outwardly projecting fingers rigidly fixed thereon for finger movement through a third generally obround path intersecting said second path adjacent the nadir thereof for receiving products stripped from said slotted wheel, the fingers of one conveyor being positioned in said third path in longitudinally interlaced relation to the fingers of the other conveyor, said fingers being generally L-shaped with one leg of the L-shape being fixed to its associated conveyor and the other leg of the L shape being of the order of about one product length above the point on one leg fixing when said finger is in said third path.

4. The apparatus of claim 3 in which said advancing means provides a termination of said first path adjacent the zenith of said second path, a platform being positioned on said frame adjacent the nadir of said third path.

* * * * *